US007543460B2

(12) United States Patent
Cruise et al.

(10) Patent No.: US 7,543,460 B2
(45) Date of Patent: Jun. 9, 2009

(54) MULTIPLE INTERCHANGEABLE CARRIER ATTACHMENT SYSTEM

(76) Inventors: Barbara Cruise, 33-54 83 St., Apt. G1, Jackson Heights, NY (US) 11372; Gerald Buck, 85-59 Chevy Chase St., Jamaica Estates, NY (US) 11432

( * ) Notice: Subject to any disclaimer, the term of this patent is extended or adjusted under 35 U.S.C. 154(b) by 0 days.

(21) Appl. No.: 10/273,061

(22) Filed: Oct. 17, 2002

(65) Prior Publication Data

US 2003/0141327 A1 Jul. 31, 2003

Related U.S. Application Data

(60) Provisional application No. 60/330,049, filed on Oct. 17, 2001.

(51) Int. Cl.
*A44C 15/00* (2006.01)

(52) U.S. Cl. ..... 63/21; 63/40

(58) Field of Classification Search ..... 63/1.16, 63/3, 4, 13, 20, 23, 38, 40, 29.1
See application file for complete search history.

(56) References Cited

U.S. PATENT DOCUMENTS 1,515,499 A * 11/1924 Lederer ..... 59/79.2
3,657,774 A * 4/1972 Reynolds ..... 24/298
6,880,364 B1 * 4/2005 Vidolin et al. ..... 63/40

* cited by examiner

*Primary Examiner*—Jack W. Lavinder
(74) *Attorney, Agent, or Firm*—Peter D. Aufrichtig; McCarthy Fingar LLP

(57) ABSTRACT

A multiple interchangeable carrier attachment system including a carrier and at least one attachment releasably attached to the carrier and adapted to be exchanged with attachments from other carriers which releasably attach to the carrier or attachment. Name or other identifying indicia is placed on each attachment which may be releasably connected to the carrier and the owner of the carrier can exchange attachments having his or her identifying indicia with owners of other carriers having their identifying indicia for trade, friendship and other purposes.

14 Claims, 2 Drawing Sheets

MULTIPLE INTERCHANGEABLE CARRIER ATTACHMENT SYSTEM

This application claims the priority of prior application No. 60/330,049 filed on Oct. 17, 2001.

BACKGROUND OF THE INVENTION

The invention is generally directed to a multiple interchangeable carrier attachment system and, in particular, to a system in which a series of attachments denoting a name, nickname, date, product identification, name/number combination or other identifying material are interchangeably secured to the carrier for trading attachments with others.

Generally, there is a need for a product to provide a bonding experience through trading and collecting. While particularly suitable for children and teenagers, the system is appropriate for people of any age. Currently, teenagers and children frequently buy items such as key chains, necklaces, pencils, signs and the like with their names on them. However, these items are generally retained by them for their personal use. There is a need for children to be able to collect identifying items with their friends' and relations' names in addition to their own, providing them with the opportunity to bond with their friends and acquaintances, to support causes, institutions and products, as well as to collect different attachments. In the past, each of these items have been generally created as single-purpose devices secured to a single carrier. Examples of these include key chains with a child's name, pens with beads spelling someone's name, a school name, a sports team's name, or lucky numbers or the like. However, there is a need for a carrier, such as a pen, necklace, bracelet, earrings, ring, clothing or accessory items like key chains, handbags, belts, hair clips, with attachments which are interchangeably removable from the carrier, so that the owner of one carrier can exchange attachments special to them with friends or acquaintances.

SUMMARY OF THE INVENTION

The invention is generally directed to a carrier with a number of attachments removably attachable to the carrier wherein the attachments can be exchanged with attachments from other carriers so that carrier owners can display attachments from another carrier owner's carrier.

A variable number of attachments can hang from a single carrier at one time. The attachments are easily removable and additional attachments can be fastened to existing attachments through a ring or other device connected to the bottom or a portion of each attachment. The number of attachments attached to the carrier is variable and can be changed at any time the carrier owner chooses.

Accordingly, it is an object of the invention to provide an improved multiple interchangeable carrier attachment system.

Another object of the invention is to provide an improved multiple interchangeable carrier attachment system in which a carrier has a number of similar attachments with identifying material on the attachment which are easily removable and which can be supplemented by adding additional attachments and may be exchanged with other attachments from other people's carriers.

Yet another object of the invention is to provide an carrier with interchangeable and selectively removable attachments which can be traded and collected.

Still other objects and advantages of the invention will, in part, be obvious and will, in part, be apparent from the specification.

The invention accordingly comprises the features of construction, combination of elements, arrangement of parts, combinations of steps and procedures, all of which will be exemplified in the constructions and processes hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

In a preferred embodiment of the invention the product is composed of two parts: a carrier; and a series of attachments to the carrier, which are removably attachable to the carrier. Generally, the product will be sold with a number of similar attachments. For example, a necklace or bracelet or ring may be sold with five or six attachments which are the owner's name in a beaded form. Generally, a young girl may purchase or have purchased for her a necklace that has five or six attachments with her name in beads hanging down from the necklace. She may then exchange an attachment with her name with a friend who provides her with an attachment with the friend's name to be placed upon her necklace. In this way, a girl may have a necklace which includes the names of a number of her friends and her friends will have necklaces which include her name. This is a way in which a bonding experience is provided to youngsters, as well as adults, and also may be used for trading and collecting.

While it is relatively common for children, such as boys and girls, to collect items such as key chains, necklaces and the like, with their name on them, there is a need to create a bonding experience through trading and collecting with their friends and acquaintances. In a current preferred embodiment of the invention, the connection to the carrier consists of a lobster claw style clasp that opens and closes to easily remove the attachment from the carrier. Alternatively, spring loaded devices, jewelry closures, knots and other means of removably opening and closing the carrier or disengaging mechanisms for the attachments can be utilized.

Figure 2:
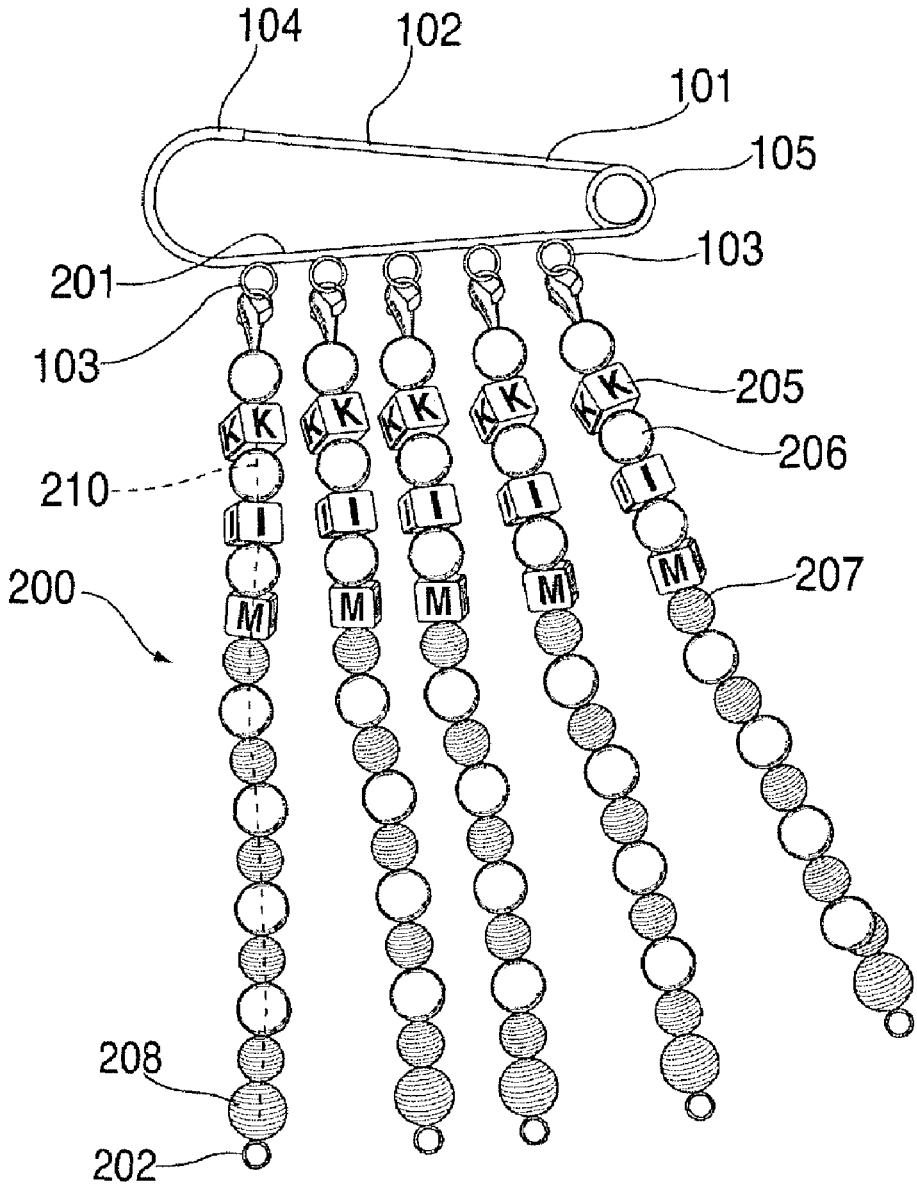
FIG. 2 is a front elevational view of a carrier with attachments constructed in accordance with another preferred embodiment of the invention.

The carrier in preferred embodiments can either be jewelry, clothing or accessories. For example, jewelry types include pins, necklaces, bracelets, earrings and rings. Clothing includes jackets, pants, shirts, hats, scarves and the like. Accessories include key chains, handbags, belts, hair clips, hair claws, headbands, scrunches, barrettes, brief cases, backpacks, name plates and others. In a current preferred embodiment a kilt pin of the type shown in FIG. 2 is used. Pin 101 has five rings 103 on the fixed (non-opening) side of pin 201. Pin 101 also has a pin section 102, which fits removably into guard lock 104, and has a spring 105 at the narrow end of pin 101 and a rounded section 106 at the wide end of pin 101.

Additional attachments with or without carriers can be purchased by users for more trading or collecting. The attachments themselves can function without the carrier by connecting end to end, using the bottom ring on one end and the clasp on the other, resulting in necklaces, bracelets, belts, etc., depending upon the number and size of the attachment pieces.

In a current preferred embodiment of the invention, the attachments 200, as shown in FIG. 2, are formed as name strips 200 shown in FIG. 2. Named strips 200 are formed of a series of beads which, preferably, include letter beads 205, spacer beads 206, colored beads 207, anchor bead 208, lobster claw connector 201 and base ring 202, which are held together by a filament 210. In a current preferred embodiment of the invention the filament 210 is a high tech elastic polymer jewelry cord, preferably approximately 0.7 millimeters thick, which has a degree of elasticity. In the current preferred embodiment the attachment is held together by a high tech elastic polymer jewelry cord 7 millimeters in thickness and clear, which is sized so as to have a unstretched length shorter than the length of the beads 205, 206, 207 and 208, through which it travels. By having the cord 210 under tension, it stiffens the attachment so that it maintains a relative straight orientation rather than flopping about. As shown in FIG. 2 the monofilament is tied to a lobster claw connector 201 which fits through one of the five fixed rings 103 on the base of carrier 101. In a current preferred embodiment the attachment is set up as a name chain or bracelet. In the example of FIG. 2 the name is Kim and there are three letter beads 205 in each chain, one with each of the three letters in the name. In a current preferred embodiment the name beads are four sided rectangular beads with a vertical hole through the beads. The letter beads 205 are separated by spacer beads 205, one of which starts at the top and subsequent ones alternate with the letter beads 205 and colored beads 207. At the bottom of the attachment is an anchor bead 208 which is slightly larger in size than the spacer to provide a visual setoff from the string of alternating spacing and letter or color beads and to provide an anchor for the metal split ring at the bottom which, in a current preferred embodiment, is a 5 millimeter ring. The split metal ring at the bottom is useful for either forming the attachment into a bracelet by attaching the ring into the metal fastener such as the lobster claw, which in a preferred embodiment is a 6-7 millimeter size, or attaching additional attachments below the attachment secured to the carrier. The spacer and colored beads are, in a current preferred embodiment, colored plastic beads of 6 millimeter size between the alphabet beads and 8 millimeters for the anchor beads. Other sizes and configurations can be utilized. The current sizing is selected in view of the way in which the spacer beads and surfaces nest within the openings in the top and bottom of each of the alphabet plastic beads to provide a cleaner, tighter fit and arrangement. With the elasticity of cord 210 the beads line up in a stiff, straight orientation which allows the name to be easily read.

Figure 1:
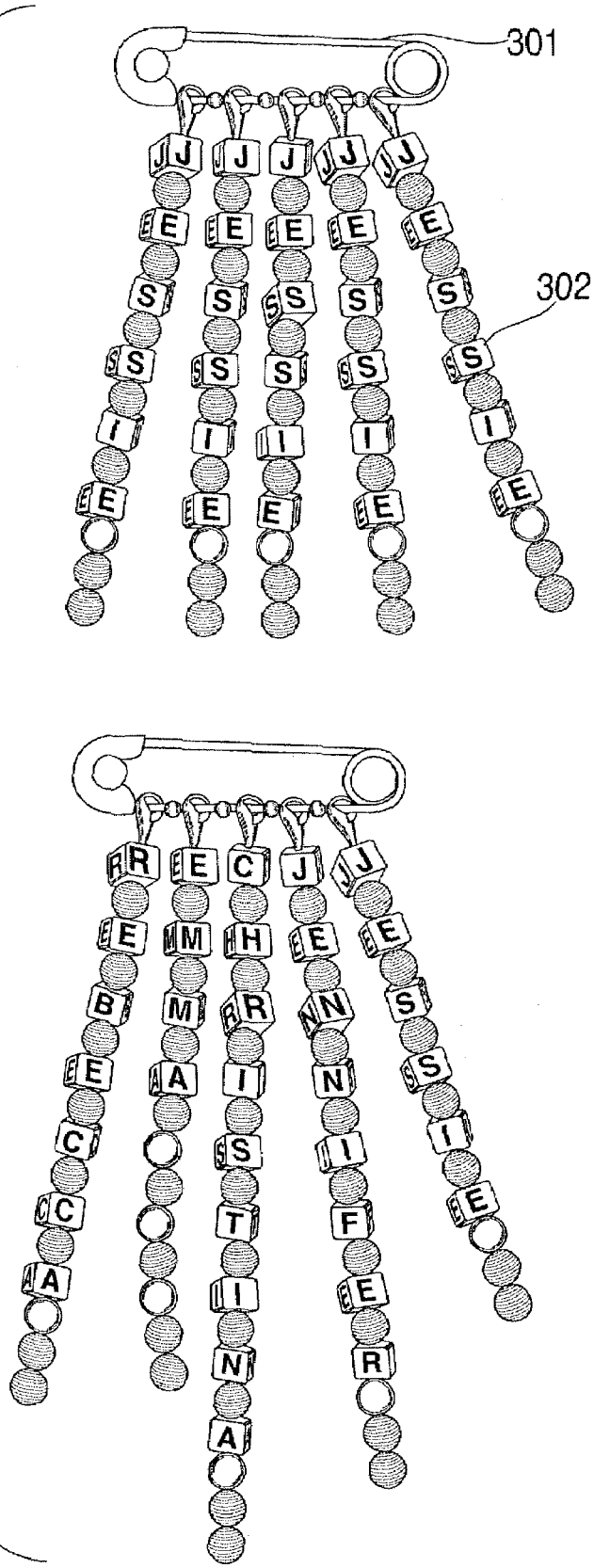
FIG. 1 is a front elevational view of two carriers with attachments constructed in accordance with a first preferred embodiment of the invention.

Reference is made to FIG. 1 wherein two carriers 301 with five attachments 302 are shown. The top carrier includes five similar attachments which would be the way one would buy the carrier. The bottom carrier shows the carrier with five different attachments (what would happen after the purchaser, Jessie, traded attachments with her name to her four friends, Rebecca, Emma, Christina and Jennifer receiving one of theirs in exchange). In the embodiment of FIG. 1 the carrier 301 is a pin in which the head of the pin can be removed. The fasteners are connected directly to the carrier without the need for fixed rings and are separated by spacer beads.

In a preferred embodiment the product will be used in the following manner. The initial five attachments to the carrier are traded between friends, resulting in a carrier with potentially five different names. The attachments are easily removable for trading so that a set of attachments can be changed at any time. For example, Mallory buys a pin with five "Mallory" attachments. Her four friends, Danielle, Marie, Susan and Barbara all buy pins or necklaces with five of their own names attached. Mallory trades her name attachment with Susan and then does the same with her three other friends, resulting in a carrier with attachments of her name and the names of her four friends. Her four friends need not, however, trade with all the same people. In addition, Mallory may purchase additional "Mallory" attachments, so that she can trade with additional friends and collect more names.

Alternatively, the attachments can be identified with sporting events such as the Super Bowl or Ryder Cup, or Olympics, a sporting team such a football, baseball, basketball or hockey team, or of a group such as a Cub Scout or Girl Scout troop.

The carriers are generally formed in preferred embodiments with some method of attachment such as a ring, which is either not intended to be opened, in which case the attachments will have a connecting piece which allows disengagement and re-engagement of the attachment, or the carrier itself will have a mechanism for releasably engaging the attachments, in which case the attachments either may or may not have a releaseable fastener integrated into the attachment. An important element of the multiple interchangeable carrier attachment system is the ability to trade and exchange identifying attachments with others so that each shares identifying attachments associated with the other. This is useful for creating bonding among friends and between business associates. In a sense, in a business setting this can provide an analog to exchanging business cards, where people can exchange identifying attachments, such as beaded name forms or more detailed and ornamented attachments, which might include a user's full name and contact information. These attachments could be in various forms, such as dangling chains, loops, discs, cards or charms. The attachments can be made in many different mediums such as glass, precious and semi-precious and non-precious metals, gems and stones, paper or plastic, without limitation.

Accordingly, an improved multiple, interchangeable carrier attachment system, which allows for trading and collecting of identifying indicia releasably engageable with the carrier is provided.

It will thus be seen that the objects set forth above, among those made apparent in the proceeding description, are efficiently obtained and, since certain changes may be made in the above constructions and processes without departing from the spirit and scope of the invention, it is intended that all matter contained in the above description or shown in the accompanied drawings shall be interpreted as illustrative, and not in the limiting sense.

It will also be understood that the following claims are intended to cover all of the generic and specific features of the invention, herein described and all statements of the scope of the invention which, as a matter of language, might be said to fall therebetween.

What is claimed is:

1. A multiple interchangeable carrier attachment system comprising:

a carrier;

a plurality of attachments releasably attachable to the carrier, each attachment including identical identifying indicia and adapted to be exchanged for attachments including other identifying indicia from other carriers which releasably attach to the carrier; and fixed rings attached to the carrier for receiving the attachments;

whereby a system in which trading of attachments with identifying indicia is enabled.

2. The multiple interchangeable carrier attachment system of claim 1 wherein the attachments include a fastener adapted to releasably engage with one of the fixed rings at a first end of each attachment.

3. The multiple interchangeable carrier attachment system of claim 2 wherein the attachment includes a base ring at a second end of each attachment.

4. The multiple interchangeable carrier attachment system of claim 3 wherein the base ring is adapted to engage with the fastener at its attachment's first end or a fastener from another attachment.

5. The multiple interchangeable carrier attachment system of claim 4 wherein each attachment includes a fastener at one end, a base ring at another end and the identifying indicia therebetween threaded on a support extending from one end to the other through the identifying indicia.

6. The multiple interchangeable carrier attachment system of claim 5 wherein the support is a string secured at one end to the fastener and secured at the other end to the base ring with the identifying indicia being threaded onto the string through openings extending through the identifying indicia and kept in place by the fastener and base rings at opposite ends of the string.

7. The multiple interchangeable carrier attachment system of claim 6 wherein the string is elastic and in a stretched state in the attachment.

8. The multiple interchangeable carrier attachment system of claim 6 wherein the identifying indicia include at least beads with letters, numbers or symbols.

9. The multiple interchangeable carrier attachment system of claim 8 wherein the letters, numbers or symbols form names, words or other identifying series of letters, numbers or symbols.

10. The multiple interchangeable carrier attachment system of claim 9 wherein there are multiple attachments, each of which is separately connected to a fixed ring on the carrier.

11. The multiple interchangeable carrier attachment system of claim 10 wherein the letter beads on the attachment are separated by alternating spacer beads.

12. The multiple interchangeable carder attachment system of claim 11 wherein the letter beads and spacer beads interlock with the spacer beads fitting partially into the openings in the letter beads.

13. A multiple interchangeable carrier attachment system comprising:

a carrier comprising a kilt pin;

a plurality of attachments releasably attachable to the carrier, each attachment including identical identifying indicia and adapted to be exchanged for attachments including other identifying indicia from other carriers which releasably attach to the carrier; and fixed rings attached to the carrier for receiving the attachments, whereby a system in which trading of attachments with identifying indicia is enabled.

14. A multiple interchangeable carrier attachment system comprising:

a plurality of attachments releasably attachable to the carrier including identifying indicia and adapted to be exchanged for attachments including other identifying indicia from other carriers which releasably attach to the carrier;

a carrier comprising a kilt pin having five fixed rings for receiving up to five attachments connected directly to the fixed rings;

whereby a system in which trading of attachments with identifying indicia is enabled.

* * * * *